US006173954B1

(12) United States Patent
Sierra Picon

(10) Patent No.: US 6,173,954 B1
(45) Date of Patent: Jan. 16, 2001

(54) CYCLIC VIEWER FOR SLOT MACHINES

(75) Inventor: Bernardo Sierra Picon, Parla (ES)

(73) Assignee: Sega S.A., Parla (ES)

( * ) Notice: Under 35 U.S.C. 154(b), the term of this patent shall be extended for 0 days.

(21) Appl. No.: 09/374,885

(22) Filed: Aug. 13, 1999

Related U.S. Application Data

(63) Continuation of application No. PCT/ES97/00208, filed on Aug. 6, 1997.

(51) Int. Cl.[7] ..... A63B 71/00

(52) U.S. Cl. ..... 273/143 R; 273/143 H; 273/143 HA; 273/138.1; 463/20

(58) Field of Search ..... 463/20, 16–19; 273/143 R, 143 B, 138.1, 138.2, 142 R, 142 B, 142 H, 142 HA, 138 A

(56) References Cited

U.S. PATENT DOCUMENTS

| | | | | |
|---|---|---|---|---|
| 4,674,748 | * | 6/1987 | Wismer | 273/142 HA |
| 5,118,110 | * | 6/1992 | Jones | 273/142 H |
| 5,785,594 | * | 7/1998 | Siebert, Jr. et al. | 273/138.2 |

FOREIGN PATENT DOCUMENTS

| | | | | |
|---|---|---|---|---|
| 36 01 824 | | 7/1987 | (DE) . | |
| 37 26 095 | | 2/1989 | (DE) . | |
| 3726095 | * | 2/1989 | (DE) | 273/138 A |
| 0 691 634 | | 1/1996 | (EP) . | |
| 406170034 | * | 2/1989 | (JP) | 273/138 A |
| WO 93/05484 | | 3/1993 | (WO) . | |

* cited by examiner

*Primary Examiner*—Benjamin H. Layno
*Assistant Examiner*—Sheila Clayton
(74) *Attorney, Agent, or Firm*—Helfgott & Karas, PC.

(57) ABSTRACT

A viewer for slot machines has a dihedral support (7) equipped with a large circular window (8) extended through the faces of the support (7), for the display of a disc (1) of flexible transparent or translucid plastic provided along its circumference with an alignment of images (2). The disc (1) is retained by the support (7) across its circumference and, in one embodiment, permanently maintains a dihedral configuration, showing an observer an alignment of images (2) according to a circumferential arc of variable amplitude according to the level of concealment of the front face of the assembly. In another embodiment, the disc is supported by two bracings so as to assume a "U"-shaped configuration, with two semicircular sectors and one intermediate sector.

15 Claims, 7 Drawing Sheets

CYCLIC VIEWER FOR SLOT MACHINES

This Appln is a Continuation of PCT/ES97/00208 filed Aug. 6, 1997.

BACKGROUND OF THE INVENTION

1. Field of the Invention

This invention refers to a cyclic viewer, for slot machines, which permits either the simultaneous viewing of several symbols or images along a circumferential arc that sequentially change, or the viewing of only one image, which changes within a corresponding viewing window. Such viewer may be constructed, such that it is applicable to two or more slot machines at the same time.

2. Description of the Related Art

Slot machines of the type mentioned above have been known for several years, and at an international level are based on rotating drums of a large diameter carrying images on their perimeters.

An example of this kind of machine may be observed in document EP-A-0 691 634, which discloses a cyclic viewer for slot machines offering the observer numerous changing images, comprising a motorized disc based on a flexible and transparent or translucent plastic material having images around its circumference. This type of slot machine, forbidden in Spain until recently, was authorized later on with limits including that the rotating drums could not exceed four centimeters in diameter. Obviously this limit supposes that if the images are directly arranged over the drum, their number and size are very reduced, such that the functionality of the machine is considerably reduced.

Several systems have been adopted to get around this problem, such as, for example, projection systems permitting a magnification of the images, fixed plate systems, transparent and superimposed viewing of the images by light refraction, systems based on a continuous band carrying the images to be viewed, a flexible band arranged over a series of drums, exclusively acting as guides and to drag them, such that said drums may have a diameter less than that determined as a maximum by the legislation in force, whilst the continuous band, on being a laminar body, may have any length, with no limit.

SUMMARY OF THE INVENTION

The cyclic viewer of the invention uses a laminar and flexible body as a support for symbols or images to be viewed, but with a totally different operational structure than the prior art. The cyclic viewer of the invention incorporates a disc having images along its circumference, and preferably with a uniform distribution. Such disc, which may be any diameter suitable to the number and size of the images to be viewed, is, in one embodiment, supported by an orthogonal bracing, such that its discoidal configuration is not affected by the legal restraints referred to above, and a dihedral support, which has along one of its faces a viewer in the form of a window, whose edge acts as a means of retaining the disc and permanently maintaining the dihedral configuration which it is forced into by the dihedral support aiding it. The image carrying flexible disc is preferably motorized and controlled by a phototransmitter-receiver, and illuminated by a series of lamps.

The viewer may be jointly installed over several slot machines, or in another embodiment where the disc has a U-shaped configuration, it may be used simultaneously in several machines, within permissible size limits. The disc in this U-shaped configuration may also be installed in a piece of furniture or housing and arranged over a group of slot machines where said disc is jointly applicable. Said piece of furniture will also contain a foldable door, for the display of the disc and positioning means for positioning the disc, its supports and motorized components therein. The front foldable door of the furniture or housing permits the dismantling of the viewer disc and to replace it for another, in case of deterioration thereof or to make a change of the corresponding images.

BRIEF DESCRIPTION OF THE DRAWINGS

To complement the description being made and to permit a greater understanding of the characteristics of the invention, this descriptive report is accompanied by a set of drawings as a part of the same, where with an illustrative and non-limiting character the following is represented.

DETAILED DESCRIPTION OF THE INVENTION

Figure 1:
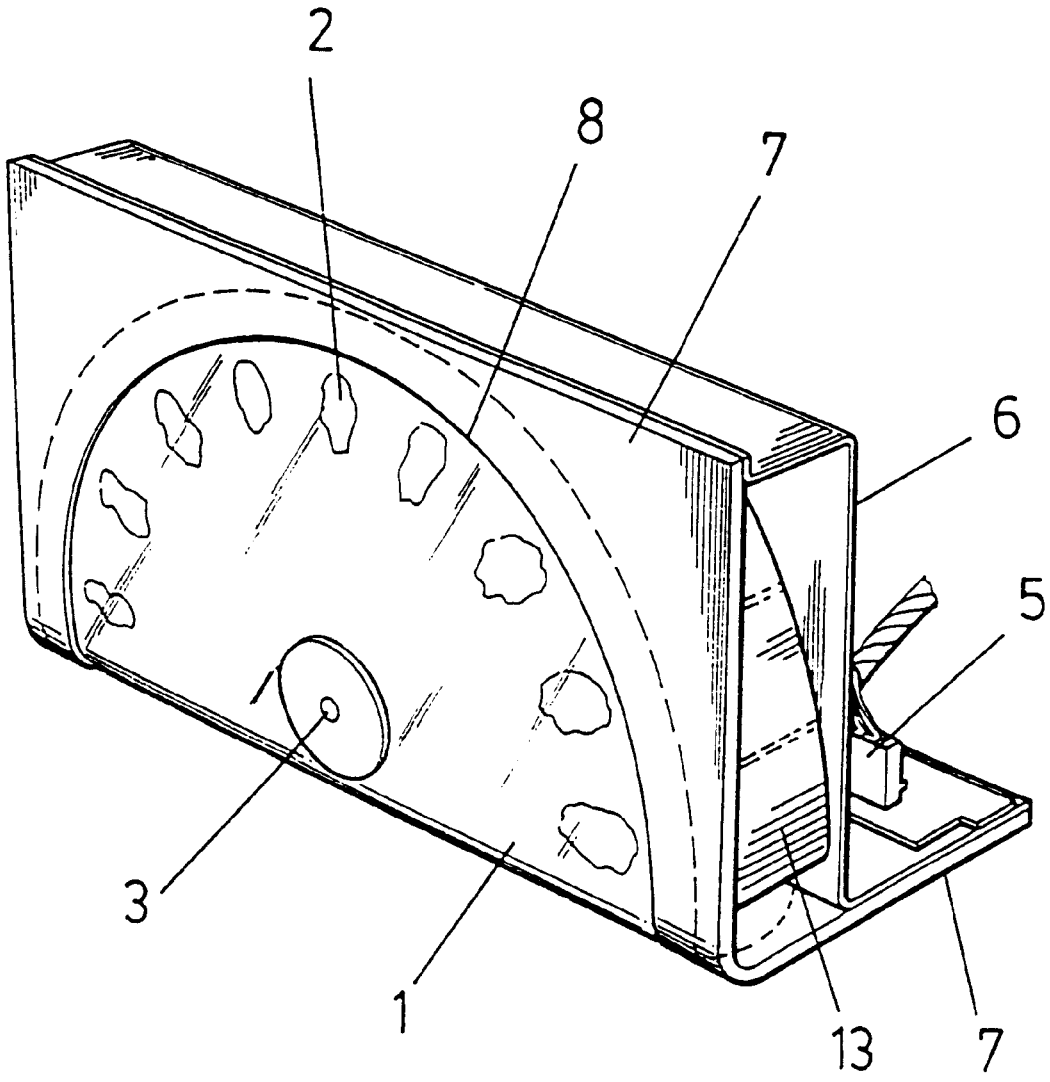
FIG. 1 is a view in perspective of a cyclic viewer for slot machines made in accordance with this invention.
Figure 2:
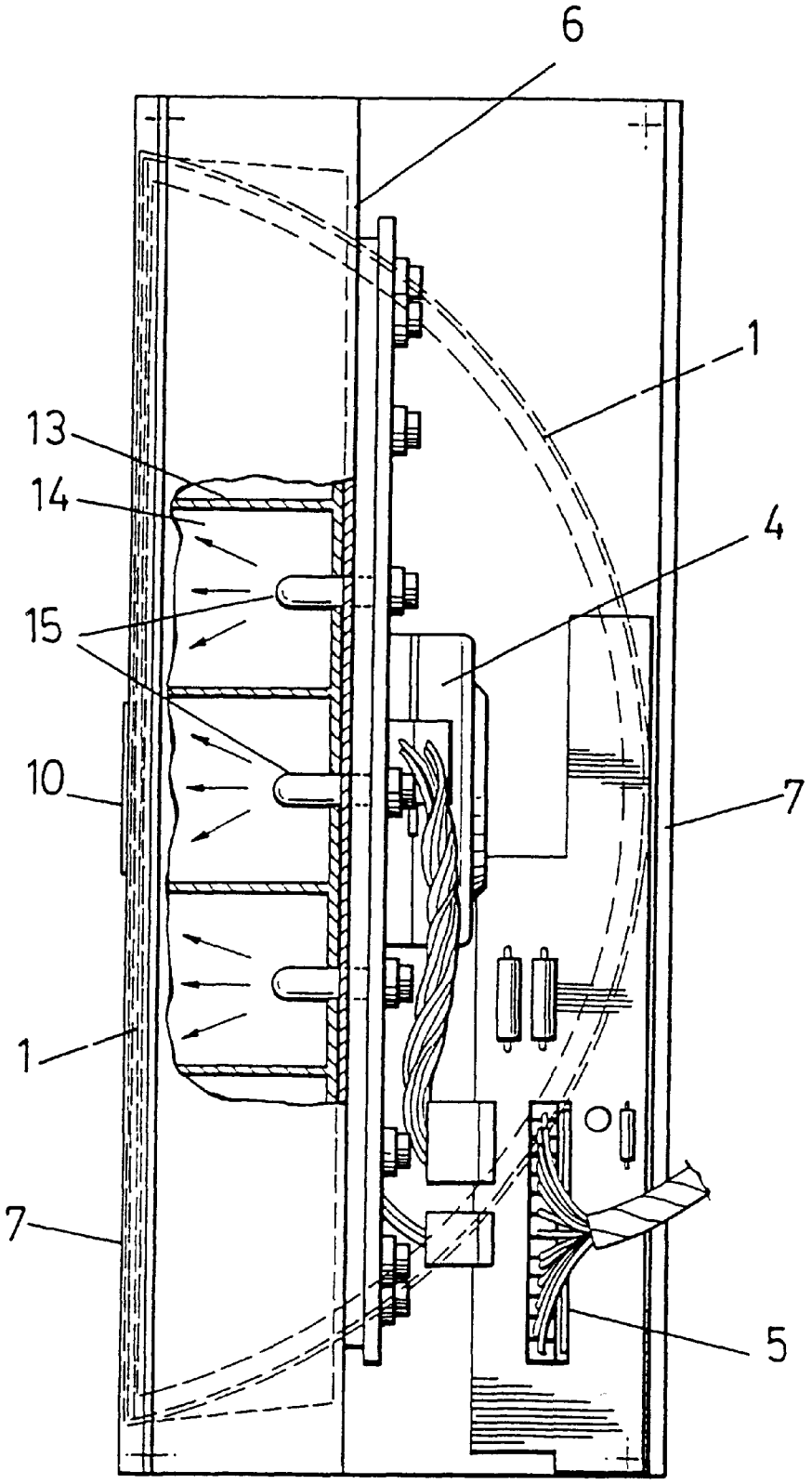
FIG. 2 is a plan view of the viewer of FIG. 1 in which the multiple box containing the luminous lamps is shown partially sectioned.
Figure 3:
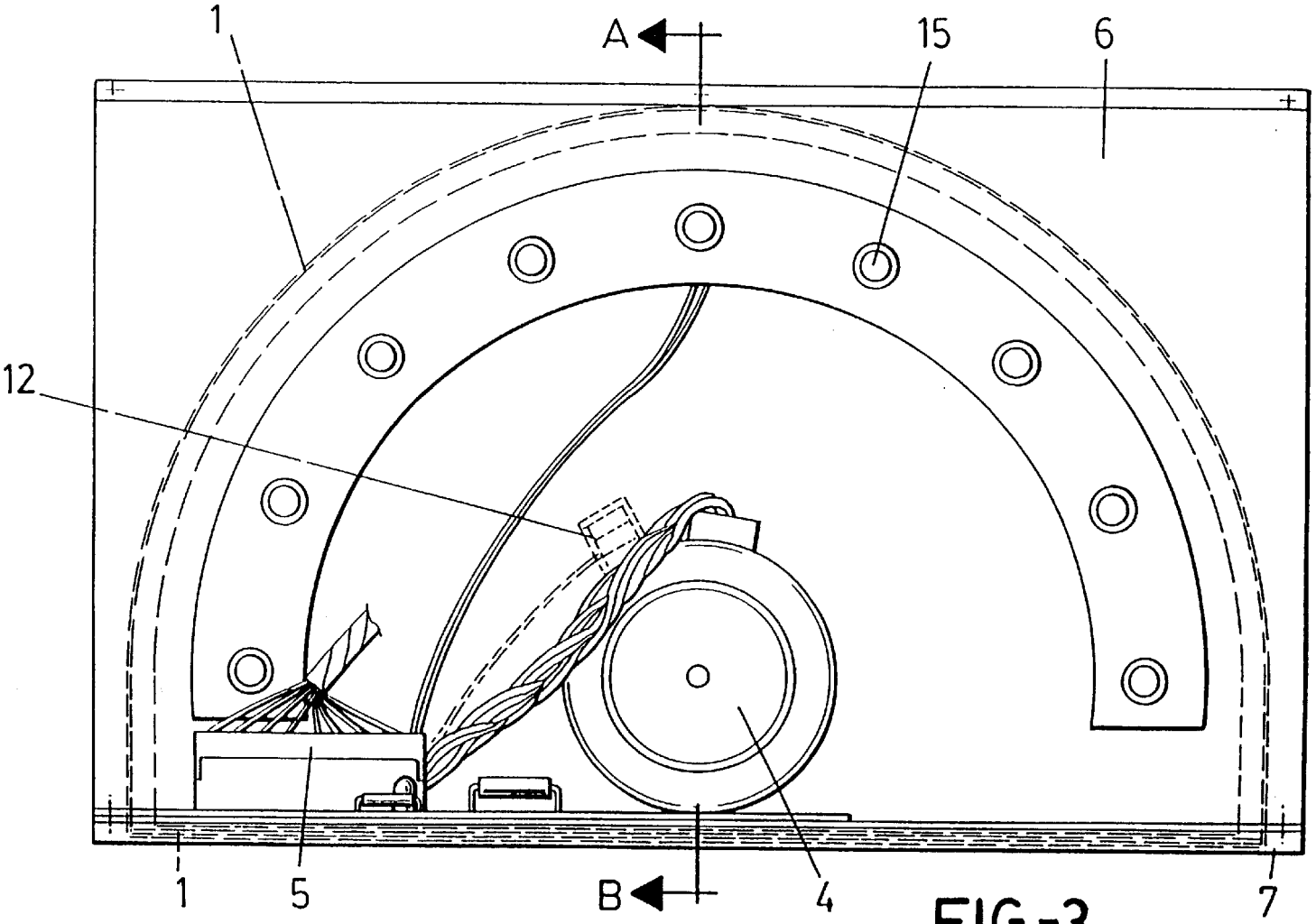
FIG. 3 is a rear elevated view of the viewer of FIG. 1.

With reference to FIGS. 1–4, the viewer of the invention comprises, in one embodiment, a disc (1) of a flexible transparent or translucid nature, having along its circumference images (2) that are to be shown to an observer cyclically. The disc (1) is fixed through a shaft (3) to an electric motor (4) which is preferably a step by step synchronous motor controlled by a circuit (5), although any other appropriate driving component may be used. The disk (1) is situated within a first support (6) interlocked with a second support (7) in a dihedral configuration, which second support (7) is provided with a wide circular window (8) having a dimension slightly less than that of the disc (1). The first support (6) also supports multiple chambers (13), each having troughs or parabolas (14) containing a luminous light (15) for improving the viewing conditions of the corresponding image (2) across the front of the machine. The window (8) forces the flexible disc (1) to adopt a dihedral configuration, which is maintained during the rotation of the disc (1).

Figure 4:
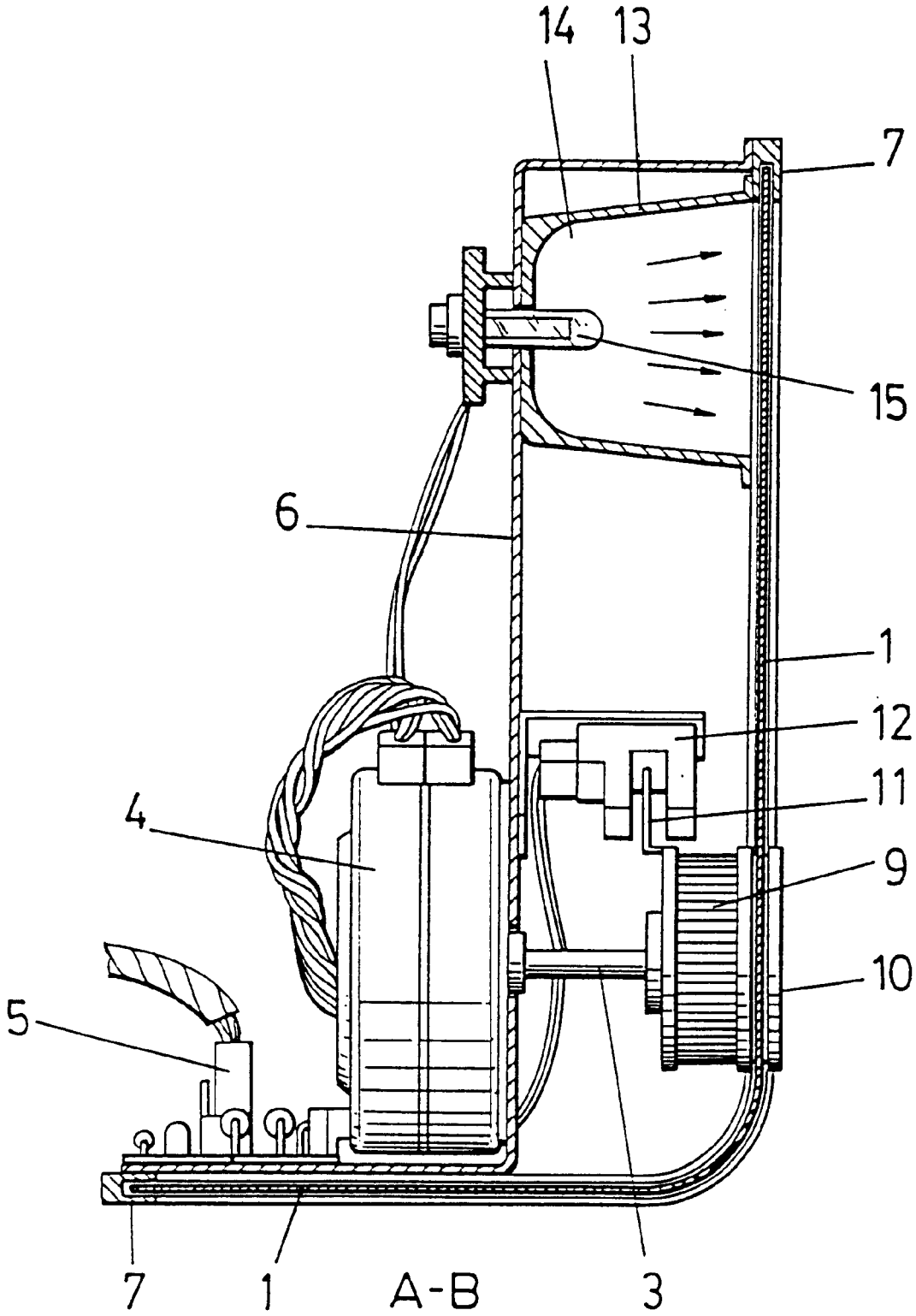
FIG. 4 is a transverse section of the viewer through line A–B of FIG. 3.

As shown more specifically in FIG. 4, the disc (1) is fixed to the motor shaft (3) by a clamp made in a cylindrical core (9) and a circular cap (10), which are interlocked with each other and the shaft (3). From the core (9), a strip (11) protrudes radially to engage a phototransmitter-receiver assembly (12) to permit the establishment of a zero setting or starting point of the disc (1). The images (2) are counted by motor (4) pulses, such that the stoppage of the disc (1) is produced in a pre-selected image (2) according to the operational program of the machine.

The cyclic viewer of the invention, in one embodiment, is basically used as an auxiliary game within the context of a slot machine, but in another embodiment may also be used as a component of a set of viewers corresponding to the main game of a machine, where the classical combinations of images susceptible of winning a prize are established, in which case the mentioned support (7) may adopt a general "U"-shaped configuration. In such an embodiment, the flexible disc of the invention constrained by two orthogonal bracings, allowing the observer to view only the diametric band between the two bracings, or more specifically one end thereof showing only one image, and permitting the necessary lateral coupling between viewers to obtain different combinations susceptible of winning prizes.

As shown in FIGS. 5–8, the disc (1'), constrained by a pair of bracings (16), is defined by a rectangular sector or intermediate section (17) and two substantially semicircular sectors (18, 18'), with the sector (18) being considered the front and over which will be printed the images as shown and described in connection with the viewer (1) of the first embodiment. These bracings (16) permit the disc (1) to be installed inside a housing (19) equipped with a front and foldable door (20) across brackets (21) in the front lower part of said housing. Guide rails (22), which guide the edges of the sectors (18, 18') of the disc (1'), are fixed to the internal face of the foldable door (20) and to an internal partition wall (23) of the housing (19). Inside said housing (19), there will also be supports and different components (24) for the mechanisms and components required in the operation of the machine, such as power supply, CPU, etc.

Figure 5:
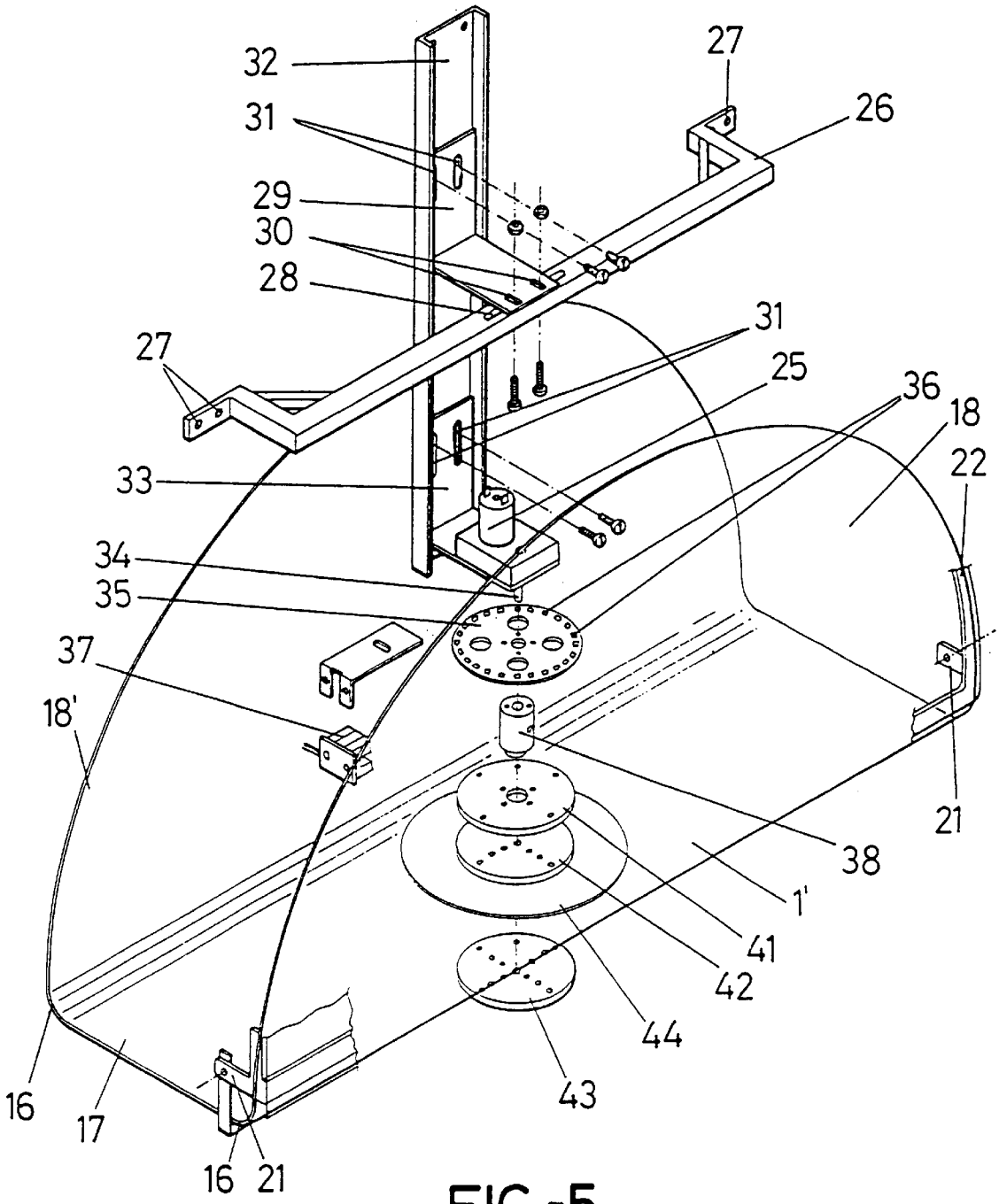
FIG. 5 is a general perspective view of an alternative embodiment of the flexible image carrying disc of the viewer of the invention which disc has a U-shaped profile.
Figure 6:
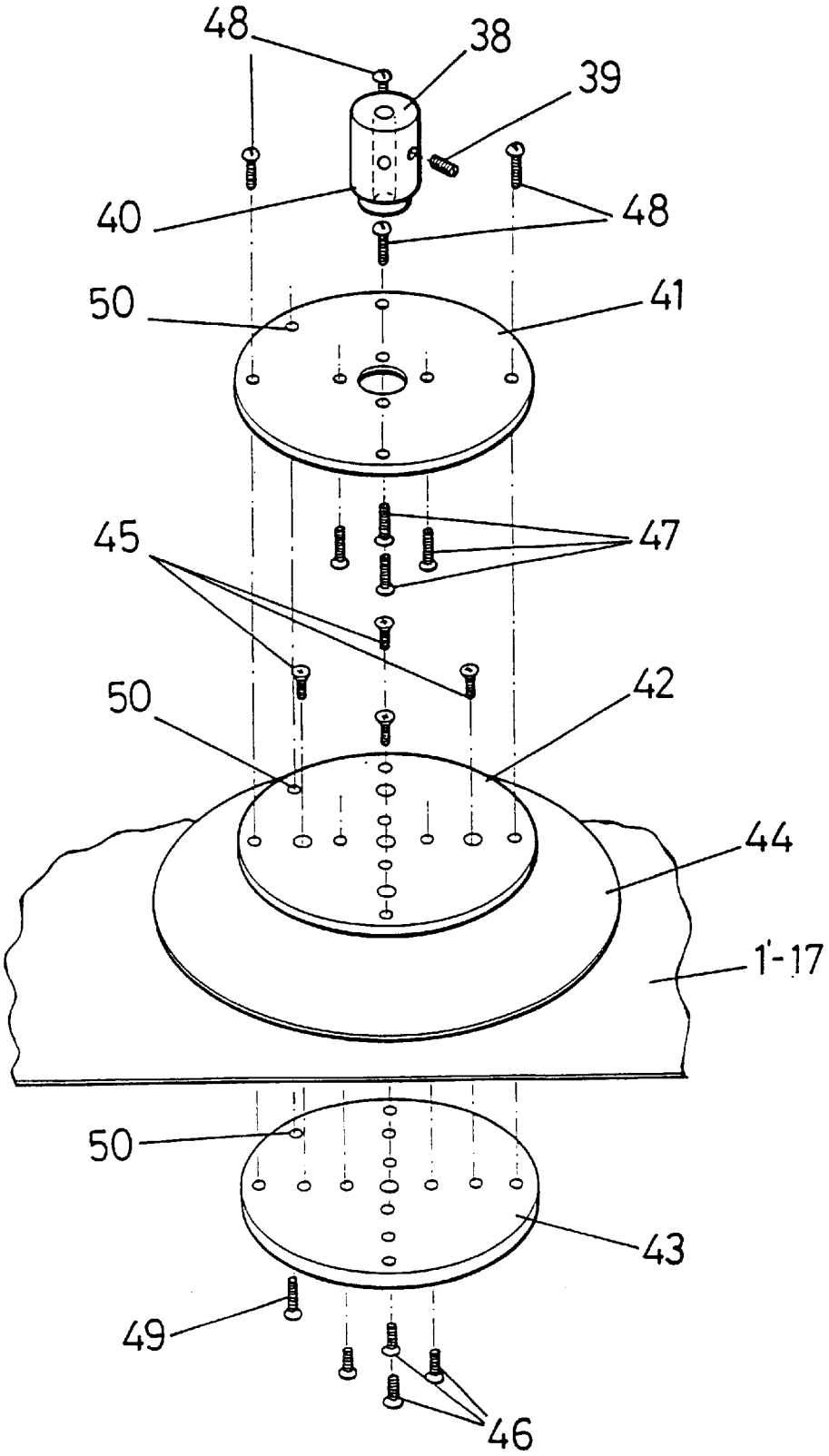
FIG. 6 is an exploded view of the components of the assembly of the U-shaped disc of FIG. 5.
Figure 7:
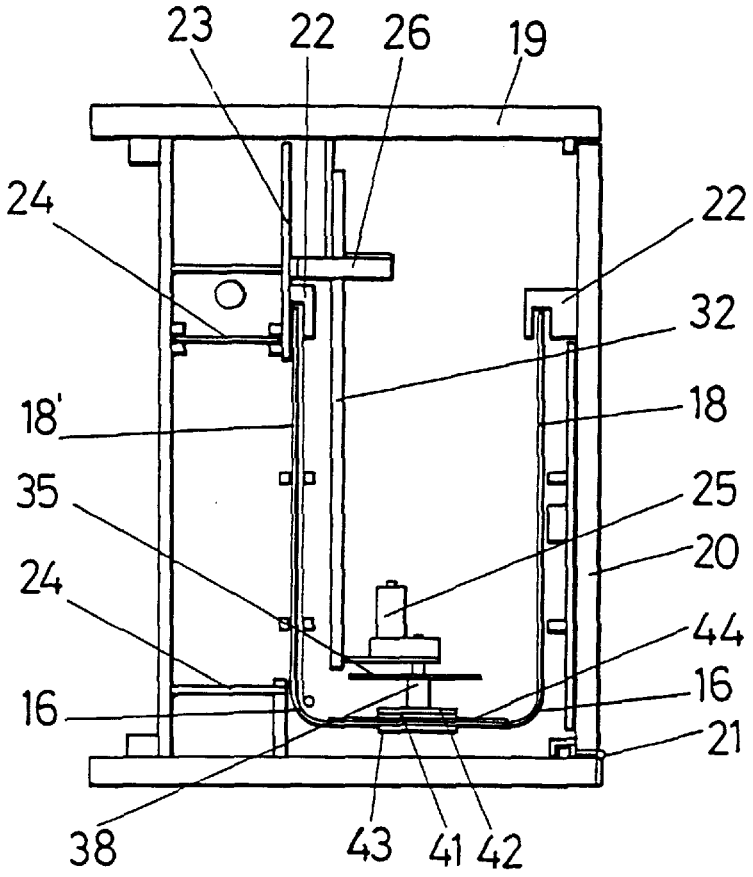
FIG. 7 is a schematic view in side elevation, with a section through a vertical plane of the disc of FIG. 5 assembled in a furniture item to be arranged on the upper part of several slot machines and simultaneously used by such machines.
Figure 8:
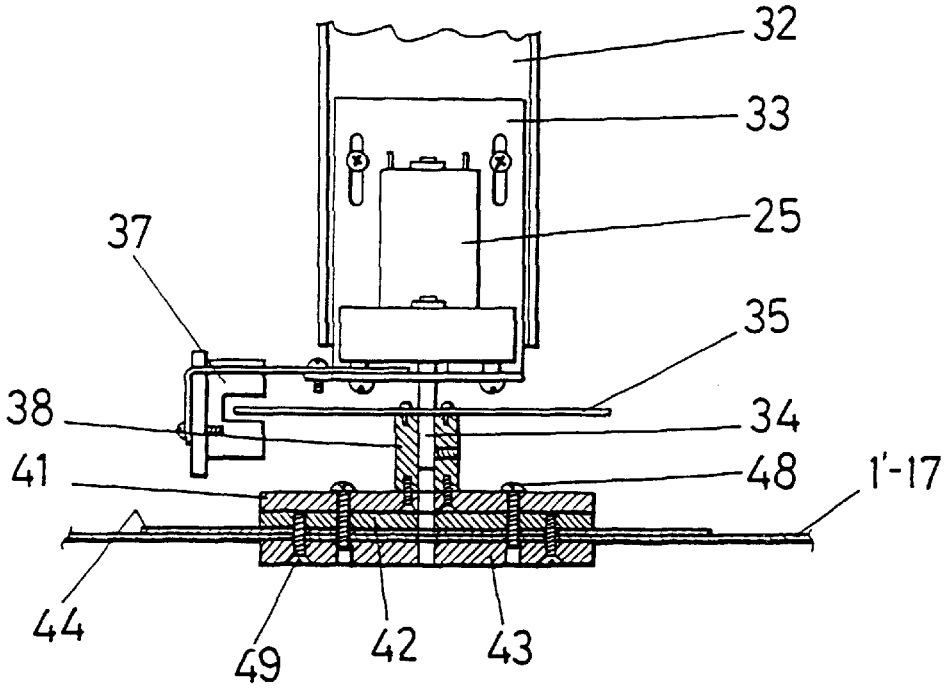
FIG. 8 is a schematic view according to a front elevation with a section through a vertical plane of the support and assembly of the motor reducer and discs of FIG. 5.

Inside the housing (19), as shown in FIGS. 5 and 7, there is also provided a support for a motor reducer (25) made from a long section (26) having end strips (27) with holes. Section (26) is fixed over the internal partition wall (23) on top of the edge corresponding to the sector (18') of the disc (1') and is equipped along its midsection with holes (28) in the longitudinal direction for the positioning of a bracket (29) along such section (26). Bracket (29) is also provided with holes (30) for varying its position forwards and backwards with respect to section (26). Bracket (29) is also provided with holes (31) to permit attachment at a certain height to a mast (32), whose lower end carries another bracket (33) which may be arranged at a certain height with respect to the mast (32). As shown in FIGS. 5 and 8, on the horizontal branch of bracket (33) is situated the motor-reducer (25), whose exit shaft (34) is interlocked with a disc (35) having holes (36) along its circumference, which holes (36) are read in their rotation by an optical reader (37). The control disc (35) is fixed to the shaft (34) of the motor by a bushing (38), to which shaft (34) is fixed by a stud rivet (39), as shown in FIG. 6. Bushing (38) is provided with notching (40) on whose annular surface are a series of holes, whose function will be explained later. The assembly of the motor reducer (25) may be perfectly adjusted so that its shaft (34) coincides with the center of the disc (1') by changing the relative positions of the bracket (29) with respect to the section (26) and the bracket (33) with respect to the mast (32).

As shown in FIG. 6, a protector disc (41) is situated above a pair of discs (42, 43), between which is located the intermediate section or sector (17) corresponding to the image carrying disc (1') and another flexible disc (44) of a greater diameter comprising a protective measure against the friction of the internal surface of the image carrying disc (1') with respect to the disc (42). Discs (42, 43, 44), together with disc (1') form a sandwich which is strengthened by screws (45, 46) and assembled to the bushing (38) by screws (47) threaded through holes in the notching (40) of the bushing (38). All of these discs are in turn fixed to each other by screws (48). In order to establish a relative position among them, a screw (49) is passed through holes (50) in said discs (41, 42, 43).

When it is desired to replace the disc (1') for another, as a consequence of the first one being deteriorated or because it is necessary to change the corresponding printing of the images and so as not to lost the synchronism, it is sufficient to loosen the screws (48) to separate the part fixed to the motor and the bushing (38) and dismantle the sandwich forming the discs (1' 41, 42, 43), prior to folding of the front door (20) of the housing.

What is claimed is:

1. A cyclic viewer for slot machines comprising:

a. a dihedral support having a first face and a second face oriented along a different plane than said first face and a window formed in at least one of said first and second faces; and b. a flexible disc having a circumference and images arranged on said circumference, said flexible disc being adapted for rotation within said dihedral support and said images being viewable through said window of said dihedral support during said rotation of said disc;

c. wherein said dihedral support maintains said flexible disc in a dihedral, substantially "L"-shaped configuration during rotation of said disc.

2. A cyclic viewer in accordance with claim 1, wherein said window and said flexible disc each have a diameter, said diameter of said disc being larger than said diameter of said window.

3. A cyclic viewer in accordance with claim 2, wherein said flexible disc is formed from transparent or translucent material.

4. A cyclic viewer in accordance with claim 3, further comprising a rear support interlocked with said dihedral support and a rotational motor supported on said second support, said motor adapted to rotate said flexible disc through a shaft connected therebetween.

5. A cyclic viewer in accordance with claim 4, further comprising lamps supported between said rear and dihedral supports for improving the viewing said images provided on said flexible disc.

6. A cyclic viewer in accordance with claim 4, further comprising a strip coupled to said flexible disc, which strip activates a phototransmitter-receiver motor connected to said rear support, said phototransmitter-receiver motor being further adapted to control the position of said flexible disc through control of said rotational motor.

7. A cyclic viewer for slot machines comprising:

a. a housing having a front door and a pair of orthogonal supports contained therein; and b. a flexible disc having a diameter and a circumference and images arranged on said circumference;

c. said flexible disc being supported within said housing by said pair of orthogonal supports arranged in a spaced apart parallel relationship on either side of a diameter of said flexible disc such that said flexible disc forms a substantially "U"-shaped configuration having a first and second substantially semi-circularly shaped sectors and an intermediate diametric sector disposed therebetween;

d. said flexible disc adapted for rotation within said housing while in said "U"-shaped configuration and said images being viewable along said intermediate sector during said rotation of said flexible disc.

8. A cyclic viewer in accordance with claim 7, wherein said flexible disc is formed from transparent or translucent material.

9. A cyclic viewer in accordance with claim 7, further comprising a pair of guides attached to said housing for supportive guiding of said semi-circular shaped sectors of said flexible disc during rotation thereof.

10. A cyclic viewer in accordance with claim 7, further comprising a position-adjustable motor-reducer assembly attached to said housing and adapted for attachment to said flexible disc in the region of said intermediate diametric sector of said flexible disc.

11. A cyclic viewer in accordance with claim 10, further comprising a position-determinative disc attached between said motor-reducer assembly and said flexible disc, and further comprising an optical reader for interpreting said position-determinative disc.

12. A cyclic viewer in accordance with claim 10, further comprising a plurality of strengthening discs coupled to said motor assembly, said strengthening discs being sandwiched around said flexible disc and having a diameter that is less than said diameter of said flexible disc.

13. A cyclic viewer in accordance with claim 12, further comprising a protective disc having a diameter and disposed between said flexible disc and one of said plurality of strengthening discs, said diameter of said protective disc being greater than said diameter of said plurality of strengthening discs but less than said diameter of said flexible disc.

14. A cyclic viewer in accordance with claim 7, wherein said flexible disc is removable from said housing.

15. A cyclic viewer in accordance with claim 7, wherein said flexible disc is replaceable.

* * * * *